US007559112B2

(12) United States Patent
Lee et al.

(10) Patent No.: US 7,559,112 B2
(45) Date of Patent: Jul. 14, 2009

(54) PASSAGE CONVERSION VALVE ASSEMBLY FOR A VACUUM CLEANER

(75) Inventors: Byung-Jo Lee, Gwangju (KR); Yun-Hee Park, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 766 days.

(21) Appl. No.: 11/128,673

(22) Filed: May 13, 2005

(65) Prior Publication Data

US 2006/0143852 A1 Jul. 6, 2006

(30) Foreign Application Priority Data

Jan. 6, 2005 (KR) ..... 10-2005-0001135

(51) Int. Cl.
*A47L 5/00* (2006.01)

(52) U.S. Cl. ..... 15/331; 15/334

(58) Field of Classification Search ..... 15/331–337, 15/351; *A47I 5/00, 9/00*
See application file for complete search history.

(56) References Cited

U.S. PATENT DOCUMENTS 4,377,882 A 3/1983 Dyson ..... 15/335
5,243,734 A * 9/1993 Maurer et al. ..... 15/334
5,351,361 A * 10/1994 Buchtel ..... 15/334
5,477,586 A * 12/1995 Jacobs et al. ..... 15/332
5,560,074 A * 10/1996 Graham et al. ..... 15/323
5,732,439 A * 3/1998 Cipolla ..... 15/334
6,536,074 B2 * 3/2003 Boles et al. ..... 15/331

OTHER PUBLICATIONS

British Combined Search and Examination Report dated Aug. 30, 2005 in regards to corresponding British Application No. 0512839.2.

* cited by examiner

*Primary Examiner*—David A Redding
(74) *Attorney, Agent, or Firm*—Ohlandt, Greeley, Ruggiero & Perle, L.L.P.

(57) ABSTRACT

Disclosed is a passage-conversion valve assembly for a vacuum cleaner, having a valve member having a socket for a hose nozzle and mounted in an air passage in a cleaner body, a resilient member mounted in the air passage to resiliently bias the valve member in one direction, and an actuator mounted to one sidewall of the air passage to push the valve member in an opposite direction to the resilience by the resilient member when the hose nozzle is mounted to the socket.

13 Claims, 4 Drawing Sheets

PASSAGE CONVERSION VALVE ASSEMBLY FOR A VACUUM CLEANER

CROSS-REFERENCE TO RELATED APPLICATIONS

This application claims benefit under 35 U.S.C. § 119(a) of Korean Patent Application No. 2005-01135, filed Jan. 6, 2005, the entire contents of which are incorporated herein by reference.

BACKGROUND OF THE INVENTION

1. Field of the Invention

The present invention relates to a vacuum cleaner. More particularly, the present invention relates to a passage-conversion valve assembly for a vacuum cleaner.

2. Description of the Related Art

In the field of upright-type vacuum cleaners, a passage-conversion valve assembly has already been widely used, which diverts a passage for drawing in dust-laden air. Especially, an automatic passage-conversion valve assembly controls the air passage so that a vacuum force is transmitted to a hose when a main body of the vacuum cleaner is in an upright posture, and on the other hand, controls the air passage so that the vacuum force is transmitted to a brush assembly when the main body is bent for use of the vacuum cleaner.

An example of the passage-conversion valve assembly that opens and closes an air-drawing passage formed in a brush assembly is disclosed in U.S. Pat Nos. 5,732,439 and 6,536,074. Additionally, U.S. Pat. No. 5,477,586 discloses a passage-conversion valve assembly for diverting an air passage depending on whether an extension nozzle is connected to a socket formed at one side of the main body. However, the prior conventional passage-conversion valve assemblies generally have complicated structures, thereby increasing the manufacturing cost and requiring increased maintenance.

SUMMARY OF THE INVENTION

An aspect of the present invention is to solve at least the above problems and/or disadvantages and to provide at least the advantages described below. Accordingly, an aspect of the present invention is to provide a passage-conversion valve assembly enabling convenient conversion between a brush mode and a hose mode and having a simple structure.

Another aspect of the present invention is to provide a passage-conversion valve assembly improved in reliability of the conversion operation.

Yet another aspect of the present invention is to provide a passage-conversion valve assembly that can be conveniently maintained.

In order to achieve the above-described and other aspects of the present invention, there is provided a passage-conversion valve assembly for a vacuum cleaner, including a valve member having a socket for a hose nozzle and mounted in an air passage in a cleaner body, a resilient member mounted in the air passage to resiliently bias the valve member in one direction, and an actuator mounted to one sidewall of the air passage to push the valve member in an opposite direction to the resilience by the resilient member when the hose nozzle is mounted to the socket.

The air passage includes a support part for supporting one end of the resilient member.

The valve member includes a duct part having a bent air path and a protrusion part connected to one end of the duct part.

The bent air path has a first path, and a second path perpendicularly connected to the first path and opened in one direction. The protrusion part has a third path for letting air flow therethrough.

The resilient member may be a coil spring enclosing an outer surface of the valve member.

The actuator is pivotably mounted to one sidewall of the air passage to convert a vertical movement of the hose nozzle to a horizontal movement of the valve member.

Another aspect of the present invention is achieved by providing a passage-conversion valve assembly for a vacuum cleaner, including a valve member mounted in an air passage formed in a cleaner body and having a first duct fluidly connected to a vacuum source generating a suction force, a second duct fluidly connected to a hose connector, a third duct connected to an air inlet of an brush assembly and a fourth duct mounting the hose nozzle, the first through the fourth ducts interconnected one another; and an actuator for moving the valve member by pushing one side of the valve member so as to convert the air passage.

The actuator pivots upon mounting a hose nozzle of the vacuum cleaner and converts the air passage by linearly moving the valve member.

BRIEF DESCRIPTION OF THE DRAWING FIGURES

The above aspect and other features of the present invention will become more apparent by describing in detail exemplary embodiments thereof with reference to the attached drawing figures, wherein.

DETAILED DESCRIPTION OF THE EXEMPLARY EMBODIMENTS

Figure 1:
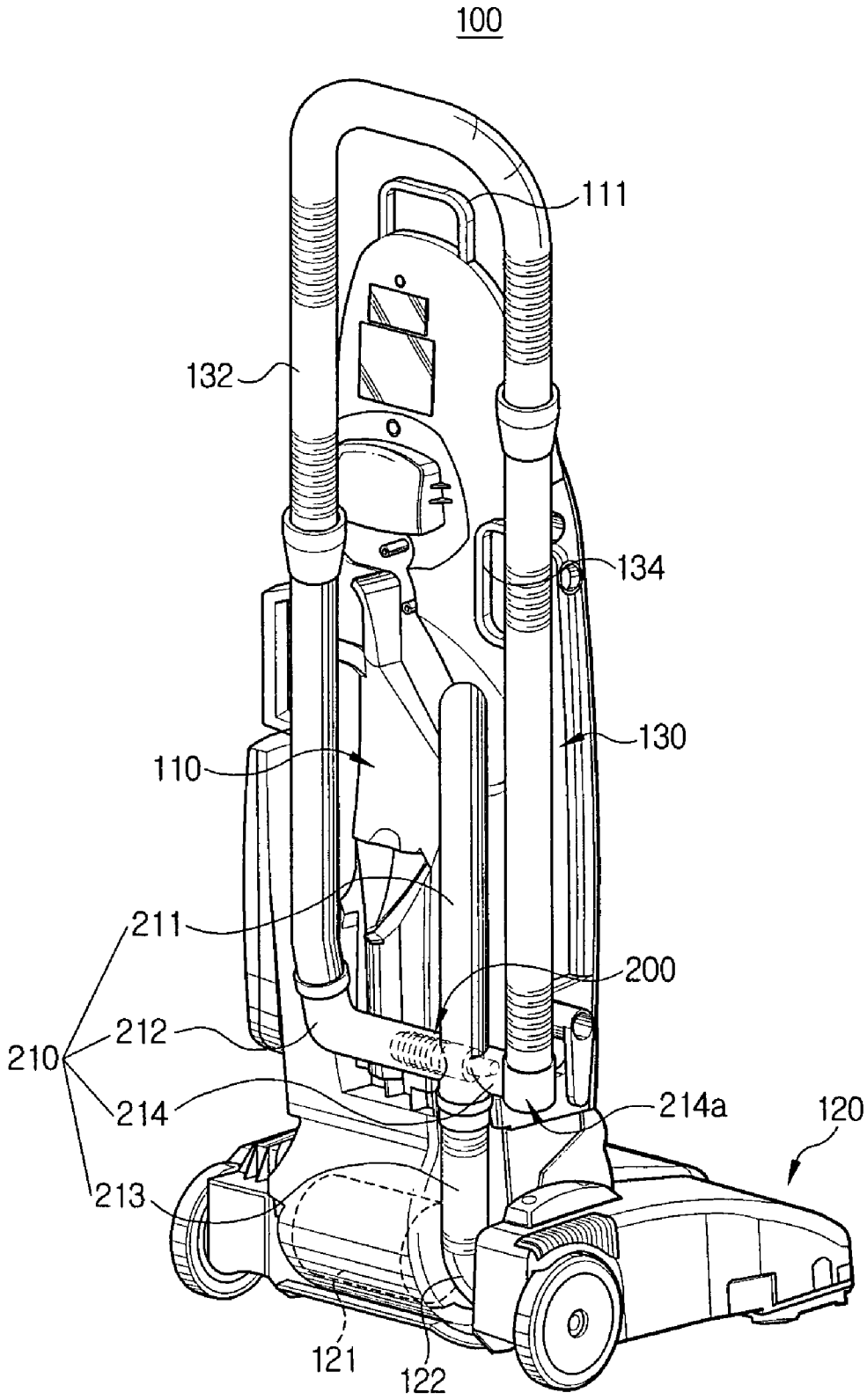
FIG. 1 is a perspective view of an upright-type vacuum cleaner applying a passage-conversion valve assembly according to an embodiment of the present invention.

Hereinafter, an embodiment of the present invention will be described in detail with reference to the accompanying drawing figures.

In the following description, same drawing reference numerals are used for the same elements even in different drawings. The matters defined in the description such as a detailed construction and elements are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

Figure 2:
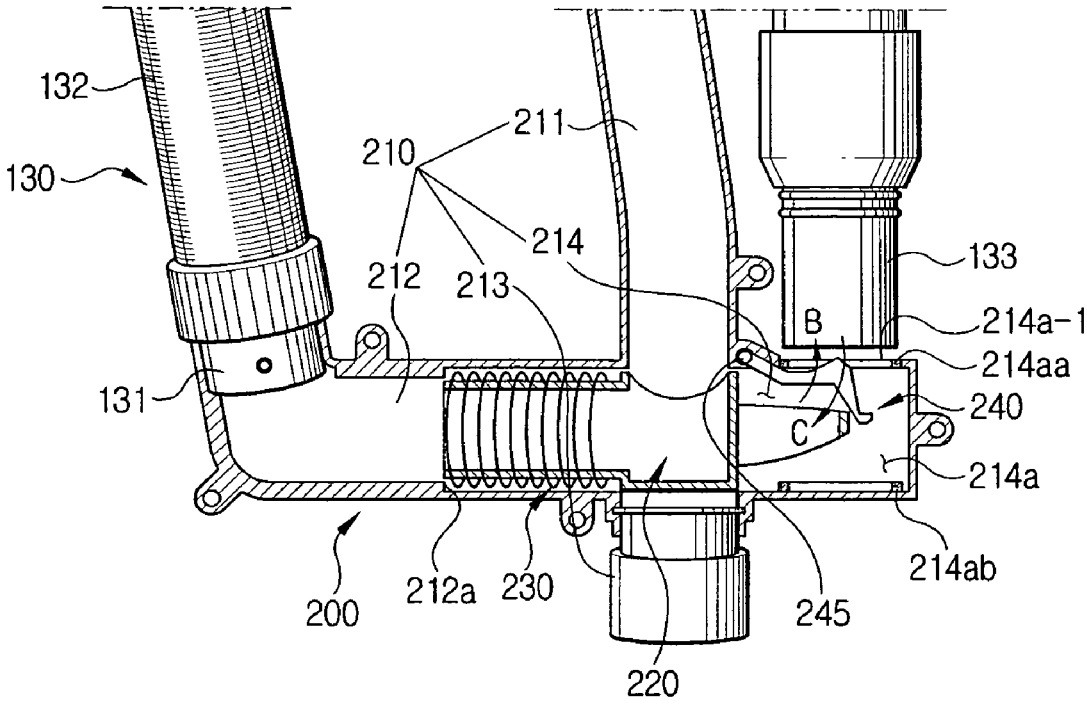
FIG. 2 is a partially sectional view of an air passage to which the passage-conversion valve assembly of FIG. 1 is mounted.

Referring to FIGS. 1 and 2, an upright-type vacuum cleaner 100 includes a cleaner body 110, a brush assembly 120, a hose 130, a vacuum source 121, an air passage 210 and a passage-conversion valve assembly 200.

The cleaner body 110 has a dust receptacle (not shown) therein, a cleaner handle 111 at an upper part thereof, for being grasped by a user to move the vacuum cleaner 100, and an air passage 210 at one side thereof. The cleaner body 110 is hingedly mounted to a brush assembly 120.

The air passage 210 includes first through fourth ducts 211 to 214. The air passage 210 is connected (e.g., in fluid communication) to the brush assembly 120 via the third duct 213, a connector 131 via the second duct 212, a hose nozzle 133 via the fourth duct 214, and the vacuum source 121 via the first duct 211.

The first duct 211 has a predetermined length upward to be connected to the vacuum source 121. The first duct 211 may be connected to the vacuum source 121 directly or through another connection means such as a flexible hose.

The second duct 212 has a predetermined length to the left to be connected to the connector 131 of the hose 130. The connector 131 of the hose 130 is inserted into the second duct 212.

The third duct 213 has a predetermined length downward to be connected to a connection pipe 122 of the brush assembly 120. The connection pipe 122 of the brush assembly 120 may be directly connected to the third duct 213 or connected to the third duct 213 through another connection means such as the flexible hose. Alternatively, the third duct 213 can be extended and directly connected to the brush assembly 120 without the connection pipe 122.

The fourth duct 214 has a predetermined length to the right to be connected to the hose nozzle 133. A socket 214*a* for connection with the hose nozzle 133 is formed at one side of the fourth duct 214. In other words, the socket 214*a* is a part of the fourth duct 214, and an opening 214*a*-1 of the socket 214*a* is sealed by insertion of the hose nozzle 133.

Annular support bands 214*aa* and 214*ab*, having a smaller diameter than an outer diameter of the hose nozzle 133, are disposed around the opening 214*a*-1 and at a lower part of the socket 214*a* in the fourth duct 214. By friction with the support bands 214*aa* and 214*ab*, the hose nozzle 133 inserted in the socket 214*a* does not easily escape from the socket 214*a*. Such support bands 214*aa* and 214*ab* are preferably made of resilient medium such as rubber having a high frictional coefficient.

The brush assembly 120 is disposed at a lower part of the cleaner body 110 and has an air inlet (not shown) for drawing in dust on a surface being cleaned such as carpet. The brush assembly 120 comprises the vacuum source 121 in this embodiment; however, the vacuum source 121 may be mounted in the cleaner body 110.

The hose 130 is for cleaning an irregular surface that is hard to be cleaned using the brush assembly 120. The irregular surface may be stairs, a shelf and a curtain. The hose 130 may be integrally formed with the air passage 210 or may be formed as a detachable accessory hose. The hose 130 comprises the connector 131 and the hose nozzle 133 that are connected to the passage-conversion valve assembly 200, a connection tube 132 for interconnecting the connector 131 and the hose nozzle 132, and a hose handle 134 (FIG. 1) for a user's grasp in using the hose 130. The relations between the hose 130 and the passage-conversion valve assembly 200 will be later described in detail.

The passage-conversion valve assembly 200 controls so that a suction force is transmitted only to the brush assembly 120 in a brush mode for cleaning a flat surface such as floor, and only to the hose 130 in a hose mode for cleaning the irregular surface such as curtain using an accessory such as the hose 130. The passage-conversion valve assembly comprises a valve member 220, a resilient member 230 and an actuator 240. The passage-conversion valve assembly 200 is disposed in the air passage 210.

Figure 3:
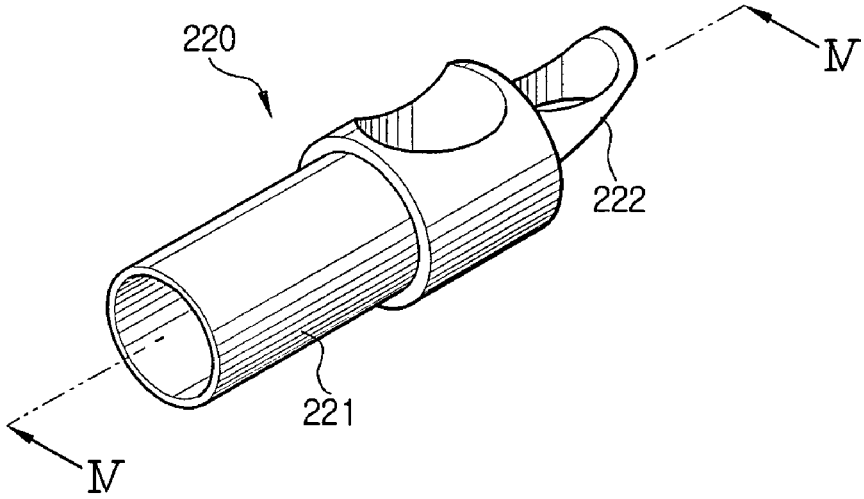
FIG. 3 is a perspective view of a valve member of FIG. 2.
Figure 4:
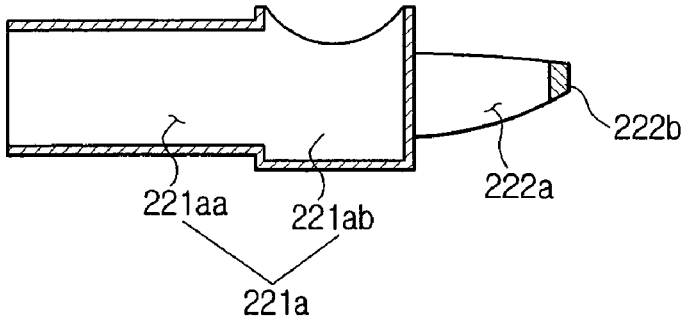
FIG. 4 is a sectional view of FIG. 3, cut along a line IV-IV.
Figure 6:
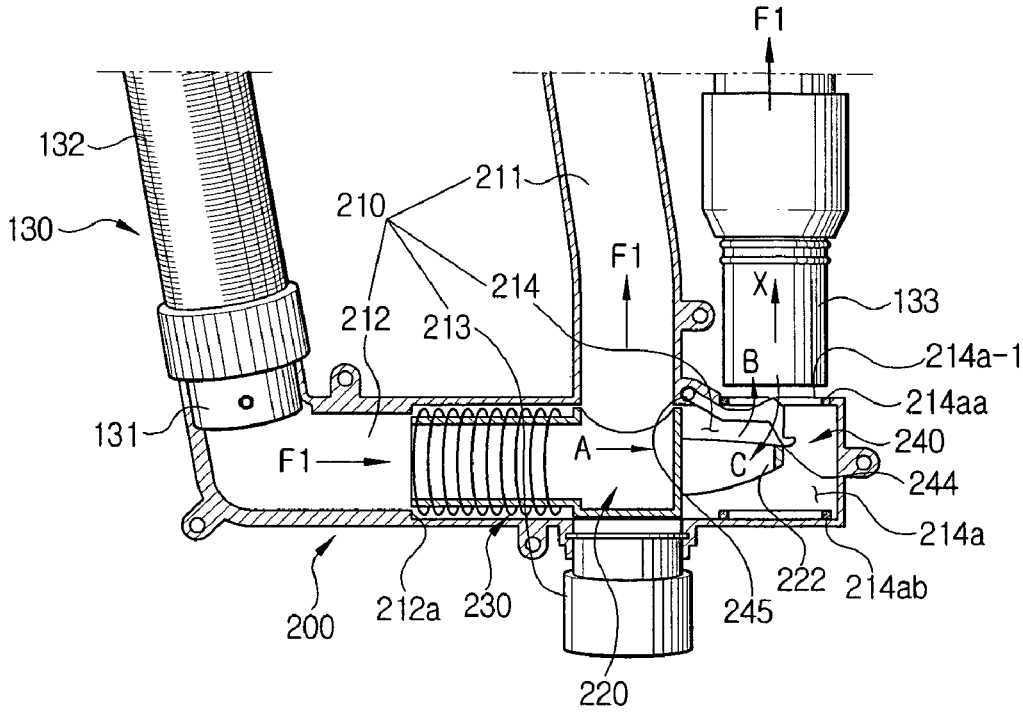
FIG. 6 is a partially sectional view of the valve member of FIG. 2 being located in a first position.
Figure 7:
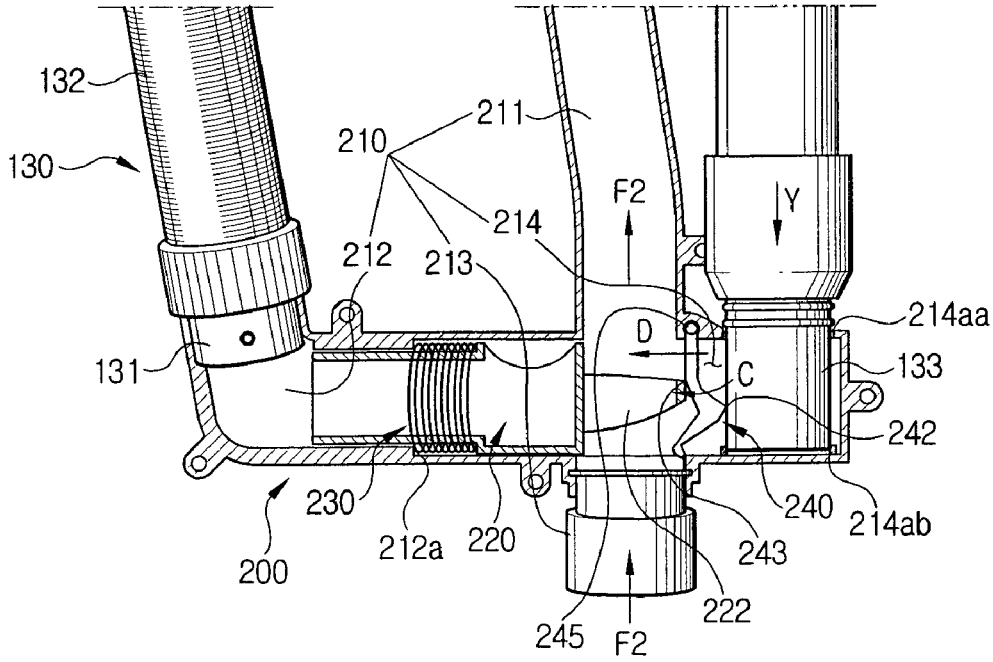
FIG. 7 is a partially sectional view of the valve member of FIG. 2 being located in a second position.

Referring to FIGS. 2 through 4, the valve member 220 comprises a duct part 221 and a protrusion part 222 and is slidably mounted in the air passage 210. The valve member 220 slides between first and second positions. When the valve member 220 is in the first position, the vacuum cleaner is in the hose mode for cleaning the irregular surface using the hose 130, as shown in FIG. 6. When the valve member 220 is in the second position, the vacuum cleaner is in the brush mode for cleaning flat surface such as floor using the brush assembly 120, as shown in FIG. 7.

The duct part 221 is a cylindrical duct for connecting the vacuum source 121 and the hose 130 in fluid connection with each other when the valve member 220 is in the first position. For this, the duct part 221 includes a bent path 221*a* therein. Referring to FIG. 4, the bent path 221*a* comprises a first path 221*aa* opened to the left and a second path 221*ab* perpendicularly disposed on the right of the first path 221*aa* in fluid connection with the first path 221*aa* and opened upward.

The protrusion part 222 has a trapezoid longitudinal section and fluidly connects the vacuum source 121 and the brush assembly 120. To this end, a third path 222*a* is provided within the protrusion part 222. A right end 222*b* of the protrusion part 222 is contacted with second and third contact portions 243 and 244 of an actuator 240.

The resilient member 230 can be a coil spring enclosing an outer surface of the duct part 221 and supported by a support part 212*a* formed in the second duct 212.

Referring to FIG. 6, when the hose nozzle 133 is separated from the socket 214*a* of the fourth duct 214 in an arrowed direction 'X', the resilient member 230 pushes the valve member 220 in an arrowed direction 'A', thereby moving the valve member to the first position shown in FIG. 6.

Figure 5:
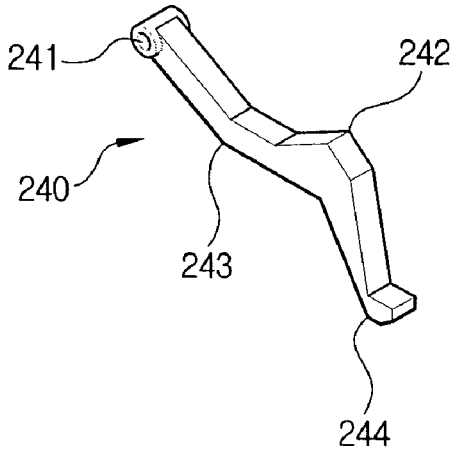
FIG. 5 is a perspective view of an actuator of FIG. 2.

Referring to FIGS. 2 and 5, the actuator 240 is pivotably mounted to one sidewall of the air passage 210 to convert a vertical movement of the hose nozzle 133 to a horizontal movement of the valve member 220. For this, the actuator 240 comprises a hinge hole 241, and first to third contact portions 242 to 244.

A hinge shaft 245 is inserted in the hinge hole 241. The actuator 240 pivots on the shaft 245 in arrowed directions 'B' and 'C'.

Referring to FIGS. 5 and 7, the first contact portion 242 is contacted with the hose nozzle 133 as the hose nozzle 133 is connected to the socket 214*a* of the fourth duct 214 in an arrowed direction 'Y'. By the contact between the first contact portion 242 and the hose nozzle 133, the actuator 240 pivots in the 'C' direction.

The second contact portion 243 is contacted with the protrusion part 222 of the valve member 220 when the hose nozzle 133 is connected to the socket 214*a* of the fourth duct 214 in the 'Y' direction. By the contact between the second contact portion 243 and the protrusion part 222, the valve member 220 is moved in an arrowed direction 'D' to be located in the second position, as shown in FIG. 7.

Referring to FIGS. 5 and 6, the third contact portion 244 is contacted with the protrusion part 222 of the valve member 220 when the hose nozzle 133 is separated from the socket 214*a* of the fourth duct 214 in the 'X' direction. By the contact between the third contact portion 244 and the protrusion part 222, the actuator 240 pivots in the direction 'B', thereby being horizontally postured.

Hereinbelow, the operations of the upright-type vacuum cleaner according to each operation mode will be described with reference to FIGS. 1, 6 and 7.

In the hose mode, the user separates the hose nozzle 133 from the socket 214*a* of the fourth duct 214 in the 'X' direction, as shown in FIG. 6, and cleans the irregular surface, grasping the hose handle 134 of the hose 130.

At this time, by the suction force of the vacuum source 121 mounted in the brush assembly 120, the dust on the irregular surface is drawn in passing through the hose 130 and the passage-conversion valve assembly 200 in an arrowed direction 'F1' and collected in the dust receptacle (not shown) in the cleaner body 110. The operation of the passage-conversion valve assembly 200 will now be described more specifically.

When the hose nozzle 133 is separated from the socket 214*a* of the fourth duct 214 in the 'X' direction, the resilient member 230 pushes the valve member 220 in the 'A' direction to thereby locate the valve member 220 in the first position as shown in FIG. 6. Therefore, the actuator 240 pivots on the hinge shaft 245 by the valve member 220 in the 'B' direction, thereby being horizontally postured.

The valve member 220 moved to the first position fluidly connects the vacuum source 121 and the hose 130 to the bent path 221*a* (FIG. 4) formed in the duct part 221. Simultaneously, the third duct 213 connected to the brush assembly 120 is blocked, and accordingly, the suction force is transmitted only to the hose 130.

In order to convert to the brush mode for cleaning the flat surface, the hose nozzle 133 of the hose 130 is connected to the socket 214*a* of the fourth duct 214 in the 'Y' direction, as shown in FIG. 7.

The user grasps the cleaner handle 111 and moves the brush assembly 120 along the flat surface. By the suction force of the vacuum source 121 mounted in the brush assembly 120, the dust on the flat surface is drawn in passing through the brush assembly 120 and the passage-conversion valve assembly 200 in an arrowed direction 'F2' and collected in the dust receptacle (not shown) in the cleaner body 110. The operation of the passage-conversion valve assembly 200 in this process will now be described more specifically.

Being connected to the socket 214*a* of the fourth duct 214 in the 'Y' direction, the hose nozzle 133 of the hose 130 pushes the first contact portion 242 of the actuator 240. Therefore, the actuator 240 pivots on the hinge shaft 245 in the 'C' direction, thereby being vertically postured. Simultaneously, the second contact portion 243 of the actuator 240 pushes the protrusion part 222 of the valve member 220 in the 'D' direction, and accordingly, the valve member 220 is moved in an opposite direction to a resilience of the resilient member 230 up to the second position shown in FIG. 7.

The valve member 220 located in the second position fluidly connects the vacuum source 121 and the brush assembly 120 to the third path 222*a* (FIG. 4) formed in the protrusion part 222. Simultaneously, the second duct 212 connected to the hose 130 is blocked. As a result, the suction force is transmitted only to the brush assembly 120.

As can be appreciated from the above passage-conversion valve assembly 200 of a vacuum cleaner, the operation mode is convertible between the brush mode and the hose mode, thereby enhancing reliability in the passage-conversion operation and convenience in use.

Furthermore, since the passage-conversion valve assembly has a simple structure, it can be facilely manufactured and managed. Also, the manufacturing cost can be reduced.

While the invention has been shown and described with reference to certain embodiments thereof, it will be understood by those skilled in the art that various changes in form and details may be made therein without departing from the spirit and scope of the invention as defined by the appended claims.

What is claimed is:

1. A passage-conversion valve assembly for a vacuum cleaner, comprising:

a valve member having a socket for a hose nozzle and mounted in an air passage in a cleaner body, wherein the valve member comprises a duct part having a bent air path and a protrusion part connected to one end of the duct part;

a resilient member mounted in the air passage to resiliently bias the valve member in one direction; and an actuator mounted to one sidewall of the air passage to push the valve member in an opposite direction to the resilience by the resilient member when the hose nozzle is mounted to the socket, wherein the actuator is pivotably mounted to one sidewall of the air passage to convert a vertical movement of the hose nozzle to a horizontal movement of the valve member.

2. The passage-conversion valve assembly of claim 1, wherein the air passage includes a support part for supporting one end of the resilient member.

3. The passage-conversion valve assembly of claim 1, wherein the bent air path comprises a first path and a second path, the second path being perpendicularly connected to the first path and opened in one direction.

4. The passage-conversion valve assembly of claim 3, wherein the protrusion part comprises a third path for letting air flow therethrough.

5. The passage-conversion valve assembly of claim 1, wherein the resilient member is a coil spring enclosing an outer surface of the valve member.

6. A passage-conversion valve assembly for a vacuum cleaner, comprising:

a valve member mounted in an air passage formed in a cleaner body and comprising a first duct fluidly connected to a vacuum source generating a suction force, a second duct fluidly connected to a hose connector, a third duct connected to an air inlet of a brush assembly and a fourth duct mounting a hose nozzle, the first through the fourth ducts interconnected one another, wherein the valve member comprises a duct part having a bent air path and a protrusion part connected to one end of the duct part; and an actuator for moving the valve member by pushing one side of the valve member so as to convert the air passage, wherein the actuator is pivotably mounted to one sidewall of the air passage to convert a vertical movement of the hose nozzle to a horizontal movement of the valve member.

7. The passage-conversion valve assembly of claim 6, wherein the actuator pivots upon mounting the hose nozzle of the vacuum cleaner and converts the air passage by linearly moving the valve member.

8. A passage-conversion valve assembly for a vacuum cleaner, comprising:

an air passage including a first duct, a second duct, a third duct, and a fourth duct in fluid communication with one another;

a socket defined in said fourth duct, said fourth duct being sealable by insertion of a hose nozzle of the vacuum cleaner in said socket;

a valve member mounted in the air passage for movement between a first position and a second position, said valve member blocking fluid communication of said first duct from said third duct when in said first position, wherein said valve member comprises a duct part defining a first air path and a protrusion part defining a second air path;

a resilient member mounted in the air passage to resiliently bias said valve member to said first position; and an actuator in the air passage, said actuator pushing the valve member to said second position to over come said resilient member when the hose nozzle is inserted in said socket, wherein said actuator is pivotally mounted to said air passage to convert a vertical movement of the hose nozzle during insertion to a horizontal movement of said valve member.

9. The passage-conversion valve assembly of claim 8, wherein said first duct is connectable to a vacuum source of the vacuum cleaner, said second duct is connectable to a hose of the vacuum cleaner, and said third duct is connectable to a brush assembly of the vacuum cleaner.

10. The passage-conversion valve assembly of claim 8, wherein said air passage comprises a support part for supporting one end of said resilient member.

11. The passage-conversion valve assembly of claim 8, wherein said resilient member is a coil spring surrounding a portion of said duct part.

12. The passage-conversion valve assembly of claim 8, wherein said actuator acts on said protrusion part.

13. The passage-conversion valve assembly of claim 8, wherein said valve member blocks fluid communication of said first duct from said fourth duct when in said first position.

* * * * *